US005579822A

United States Patent [19]

Darsy et al.

[11] Patent Number: 5,579,822

[45] Date of Patent: Dec. 3, 1996

[54] METHOD FOR OBTAINING COMPOSITE CAST CYLINDER HEADS

[75] Inventors: Eric Darsy, Chateauroux; Phillippe Meyer, Nogent/Sur/Oise, both of France

[73] Assignee: Pechiney Recherche, Paris, France

[21] Appl. No.: 411,070

[22] Filed: Mar. 27, 1995

Related U.S. Application Data

[63] Continuation of Ser. No. 920,580, filed as PCT/FR92/00003, Jan. 2, 1992, abandoned.

[30] Foreign Application Priority Data

Jan. 3, 1991 [FR] France ..... 91 00377

[51] Int. Cl.[6] ..... B22D 19/14

[52] U.S. Cl. ..... 164/95; 164/122.1

[58] Field of Search ..... 164/97, 98, 66.1, 164/95, 96, 122.1

[56] References Cited

U.S. PATENT DOCUMENTS

| | | | |
|---|---|---|---|
| 4,404,262 | 9/1983 | Watmough | 164/98 |
| 4,852,630 | 8/1989 | Hamajima | 164/98 |
| 5,074,352 | 12/1991 | Suzuki | 164/98 |

FOREIGN PATENT DOCUMENTS

| | | |
|---|---|---|
| 0129266 | 12/1984 | European Pat. Off. . |
| 2638988 | 5/1990 | France . |
| 5-832543 | 5/1983 | Japan . |
| 0008490 | 6/1914 | United Kingdom . |

*Primary Examiner*—Joseph J. Hail, III
*Assistant Examiner*—James Miner
*Attorney, Agent, or Firm*—Dennison, Meserole, Pollack & Schneiner

[57] ABSTRACT

A process is disclosed for the production of cast cylinder heads made of aluminium alloys from at least two different "liquid" alloys. The liquid alloys at the time of casting may contain solid particles of varied size and shape so as to produce composites with a metal matrix after solidifying. The process for moulding composite cylinder heads includes a number of successive layers consisting of at least two different alloys and consists in casting each alloy layer in the cavity of a mould via a feed system with a waiting time between the end of casting of one layer and the beginning of the second layer, so that the first layer contains between 50 and 100% of solid fraction in its lower part and 0 to 80% of solid fraction in the upper part, the interface region, when the second alloy is introduced.

8 Claims, 3 Drawing Sheets

1 mm 0.5 mm

METHOD FOR OBTAINING COMPOSITE CAST CYLINDER HEADS

This is a continuation of application Ser. No. 07/920,580, filed as PCT/FR92/00003, on Jan. 2, 1992, now abandoned.

BACKGROUND OF THE INVENTION

The invention relates to the production of cast cylinder heads made of aluminium alloys comprising at least two different alloys. The liquid alloys may comprise solid particles at the time of casting of varied size and shape so as to produce composites with a metal matrix after solidifying.

This technique makes it possible to optimise the choice of the materials according to the main functions required in the different parts of the cylinder heads. By way of illustration there may be mentioned the requirement of a maximum tolerance to damage by heat in the vicinity of the combustion chamber, especially in the regions between the valve seats. On the other hand, in the cold part of the cylinder head, especially the securing posts, the critical property is mechanical strength, so as to endow the cylinder head with maximum stiffness and the best possible aptitude to clamping, with a minimum weight of the finished component.

At present, however, there is no manufacturing technique permitting the problem specified above to be solved in a satisfactory and economically viable manner.

In fact, it is possible, to be sure, to investigate materials exhibiting both a high mechanical strength and good heat resistance. However, experience shows that materials of this type are costly. For example, according to the manufacturers' estimates, metal matrix composites reinforced with silicon carbide particles of the Duralcan type cost 2 to 3 times more than conventional casting alloys, and this rules out their use for the whole of the cylinder head.

In general, the use of high-performance materials must be restricted to a local application in the regions where they are indispensable, this being due to their cost.

Furthermore, so far as we are aware, there is no technique in existence enabling such materials to be inserted into a cylinder head. The insertion of aluminium alloys or of metal matrix composites (for example the AlFe AlFeCe alloys obtained by powder metallurgy, followed by bonding, high heat-performance alloys obtained by a process of the Osprey type, metal matrix composites resulting from the impregnation of preforms, for example by liquid forging—Squeeze Casting—etc) placed in the solid state in the cylinder head at the time of casting comes up against the difficulty of successful metallurgical bonding between the material of the cylinder head and that of the insert(s).

Finally, another route which is at present developed for locally reinforcing the material of a cylinder head consists of impregnation when preforms are being cast (especially with alumina or silicon carbide or reinforcements consisting of long fibres). However, technology of this type introduces high manufacturing overcosts when compared with the usual techniques of gravity and/or low pressure casting, especially because of the need to produce a partial vacuum and then to apply overpressures of several Pa which make it necessary to cover the sand cores with a protective film so that they themselves are not impregnated with liquid metal.

SUMMARY OF THE INVENTION

Applicant has therefore investigated and developed production techniques permitting different alloys to be cast in a cylinder head, and especially alloys with a high tolerance to damage on the combustion chamber side and alloys of low cost of manufacture and high mechanical strength in the remainder of the component.

The component according to the invention consists of successive, adjoining and substantially horizontal layers.

More precisely, it has become apparent that it is necessary for each layer $i_{n-1}$ ($n \geqq 2$) to meet the following conditions at the time of the casting of the subsequent layer $i_n$.

lower face of layer $i_{n-1}$ : 50 to 100% of solid fraction upper face of layer $i_{n-1}$ : 0 to 80% of solid fraction and preferably:

lower face of layer $i_{n-1}$ : 70 to 100% of solid fraction upper face of layer $i_{n-1}$ : 10 to 40% of solid fraction These conditions can be obtained by adjustment of the method of cooling of the cast metal, aiming at a maximum heat extraction via the base of each layer and waiting for the time needed for the above conditions to be established.

In practice, it is a matter of defining the waiting time, $t_w$, between the end of casting of each layer ($i_{n-1}$) and the beginning of the layer $i_{n\ (n \geqq 2)}$, as a function of the conditions of cooling of the cast component.

For obvious production efficiency reasons the aim is to make $t_w$, as small as possible by consequently sizing the system for cooling the layer $i_{n-1}$. The cooling of the cast component is generally ensured by a metal sole plate carrying a heat transfer fluid such as water.

The solid fractions are determined beforehand experimentally by thermal analysis, for example by placing at least two thermocouples in each layer ($i_{n-1}$), one in the region close to the interface with the next layer and the other in the neighbourhood of the base of the layer.

The solid fractions are determined from these thermal analyses by the use of equilibrium diagrams of the east metal which is generally assumed to be similar to an Al-based binary alloy. The principle of the calculation is given in the Appendix.

The feed systems will be adapted so that the casting of each layer $i_n$ ($n \leqq 2$) does not create any unacceptable erosion of layer $i_{n-1}$ and so that the layers are as uniform as possible. This adjustment is within the scope of a person skilled in the art, for example by virtue of the optimisation of feed channels or by the use of metal or ceramic filters placed in the feed system, in order to regulate its flow rate. It is necessary, in fact, to obtain one or more substantially planar and uniform interface(s) between the layers, which can be checked, for example, by micrography, macrography or scanning microscopy on cross-section(s) perpendicular to the interface.

The feed systems may be unsymmetrical, but they will preferably be made symmetrical to make it easier to obtain layers having uniform thicknesses.

Finally, it is possible to provide the mould cavity with inert protection by an inert gas ($CO_2$, argon, nitrogen, and the like) in order to reduce to a minimum the oxide layer which is naturally formed at the surface of the liquid metal during the casting, and hence to promote metallurgical bonding between the layers.

When the mould is filled under these conditions, cylinder heads are obtained which exhibit successive layers of different alloys with a metallurgical bond of high quality without oxide defects (see FIGS. 5 and 6), in accordance with the specifications of the motor vehicle manufacturers.

In the case of twin-alloy cylinder heads, a layer of material intended to give heat resistance is formed which typically has a thickness of 15 to 25 mm on the combustion chamber side, the remainder consisting of the second alloy.

According to the invention the process for obtaining a bi-(or multi-)metallic cylinder head is therefore carried out by successively casting in the cavity of a mould which is either metallic or made of sand, or mixed, two (or more) distinct aluminium alloys with one or more interface region(s) which is (are) as thin as possible, consisting of a mixture of the cast alloys and without any trace of oxide skins.

To do this, the alloys are introduced into the mould cavity by independent feed systems. The level of each layer is obtained by metering its quantity, for example by volume.

In order to avoid an excessively large mixing region of the two different and successive alloy layers, it is advisable to allow the alloy of layer i-1 ($i \geqq 2$) to cool so that it is pasty at the time of arrival of the liquid metal intended to form layer i.

The production of a multialloy cylinder head can take place by a gravity, low pressure, casting technique, by liquid forging (squeeze casting) or any other industrial foundry technique suitable for the production of cylinder heads.

BRIEF DESCRIPTION OF THE DRAWINGS

The invention will be better understood with the aid of the following examples illustrated by FIGS. 1 to 7.

DESCRIPTION OF THE PREFERRED EMBODIMENTS

EXAMPLE 1

Figure 1:
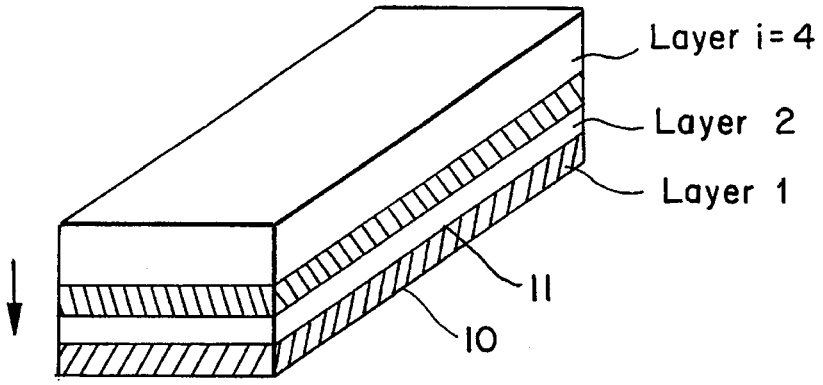
FIG. 1 shows diagrammatically a view of the cast component obtained and the direction of the applied thermal gradient (arrow).
Figure 2:
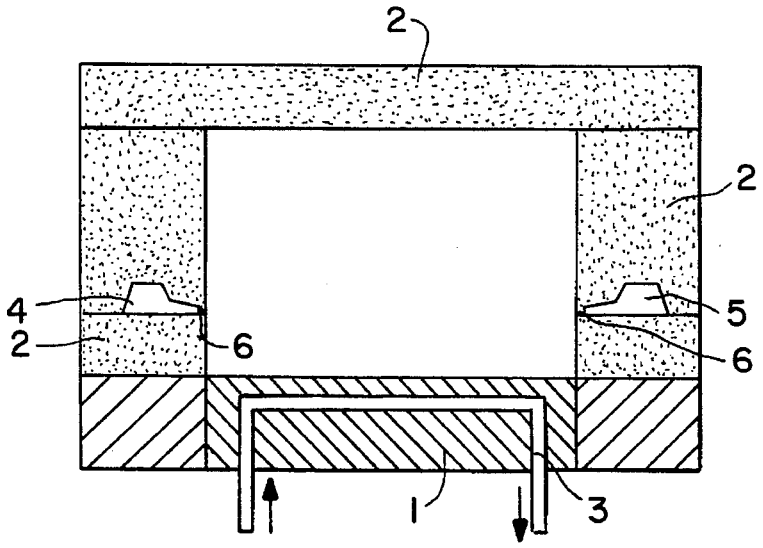
FIG. 2 shows, in cross-section, a diagrammatic view of a mould which can be employed for making use of the invention.
Figure 3:
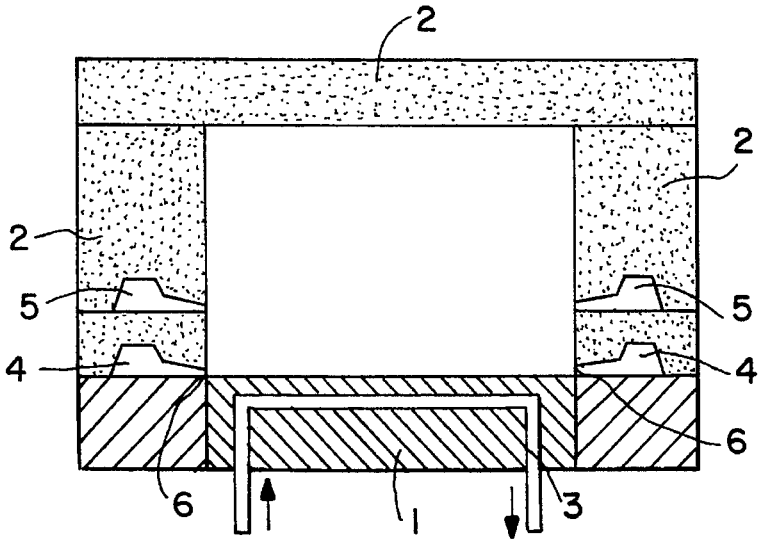
FIG. 3 shows another version of the said mould, which makes it possible to obtain the cast component shown in perspective in FIG. 4.
Figure 4:
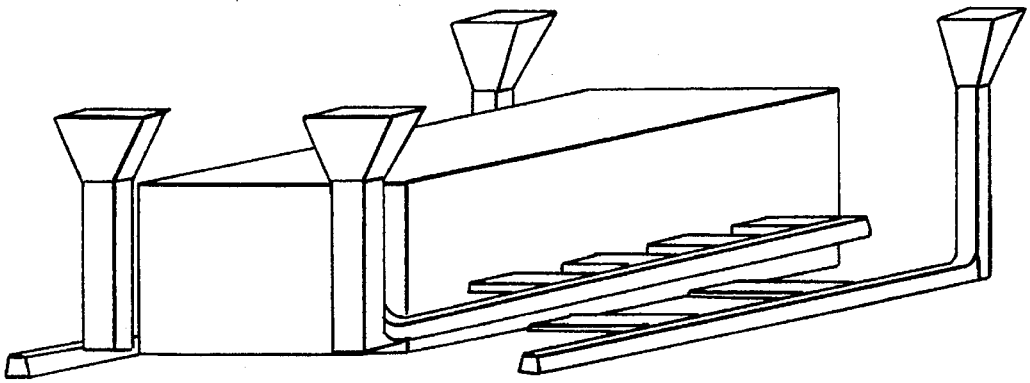
Figure 7:
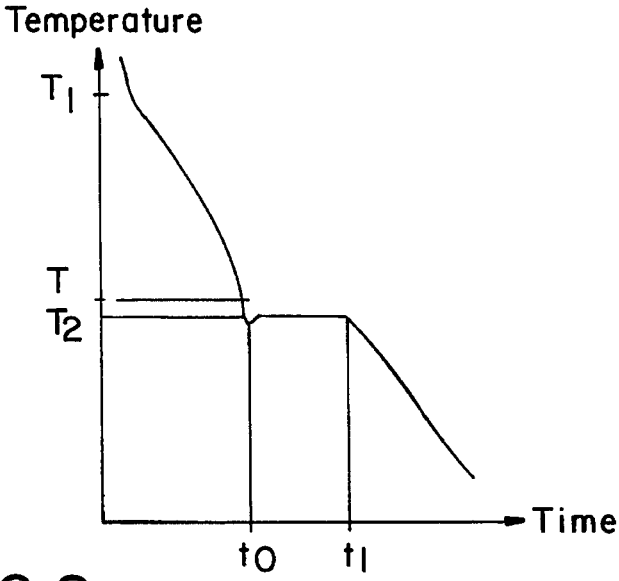
FIG. 7 shows a thermal analysis curve of the solidification of a eutectic Al—Si alloy and FIG. 8 shows the equilibrium diagram of the corresponding binary alloy (Al—Si).

Twin-alloy cylinder head: AS7G-AS5U3G (FIG.2)

The mould is made up of a metal sole plate (1) made of cuprochrome (approximate composition 60% Cu, 40% Cr) 100 mm in thickness and of sand blocks (2). This sole plate comprises a cooling circuit (3) in which water circulates so as to maintain its temperature between 80° and 100° C.

The mould is provided with two feed systems (4) and (5), vents, water and oil circulation circuit cores, entry and escape pipes and the usual runners (not shown).

The coring process is the Pepset process in the case of the blocks (2), the cores of the oil circulation circuits and the entry and escape pipes, and Ashland in the case of the water circulation circuit cores.

The first metal, AS7GO,3 (according to French Standard NF A 57702) is cast at a temperature of 710° C. (target temperature) via the feed (4) over a height of 20 mm corresponding to the thickness of the table of the cylinder head (volumetric metering). The feed system (5) is calculated so that the delivery of AS7GO,3 lasts approximately 15 s with a speed or flow rate of approximately 6.5 /min at the gates (6). As soon as the casting of the first alloy is finished, the second alloy, an AS5U3G (Standard 57702) is introduced at a temperature of 720° C. via the feed system (5) at a speed or flow rate of 30 /min at the gates so that the horizontal component of the speed of this alloy is approx. 0.5 m/s so as to fill the remainder of the mould without eroding the first metal.

The calculation of the solid fractions in the first alloy (AS7GO3) at the time of the arrival of the second metal with the aid of the recording of the temperature of the first alloy, of the Al—Si diagram and of the application of the rule of levers by applying the method given in the Appendix gives the following results:

lower part 10 (in contact with the sole plate): 82%;

upper part 11 (in the interface region): 18%.

EXAMPLE 2

Twin-alloy cylinder head—Duralcan F3A—AS5U3G

Duralcan F3A, consisting of AS7GO,3+15% of SiC particles is employed as first alloy and is cast under the same conditions as the AS7G of example No. 1. The SiC particles do not modify the thermal analysis of the alloy and the method of calculating the solidified fractions for normal aluminium alloys is applicable. Nevertheless, the casting temperature of Duralcan is increased by 20° C. so as to obtain the same fluidity as that of the pure base alloy, and therefore the same filling speeds,

APPENDIX

Method of calculation of the solidified fractions in the case of hypoeutectic alloys of Al—Si type (general case of the foundry alloys for cylinder heads).

Figure 8:
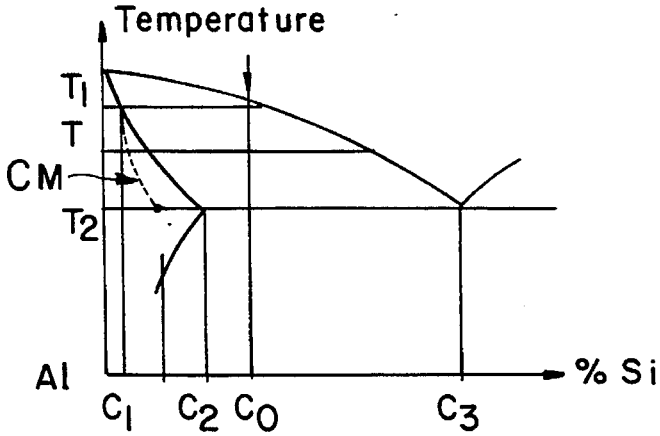
Figure 5:
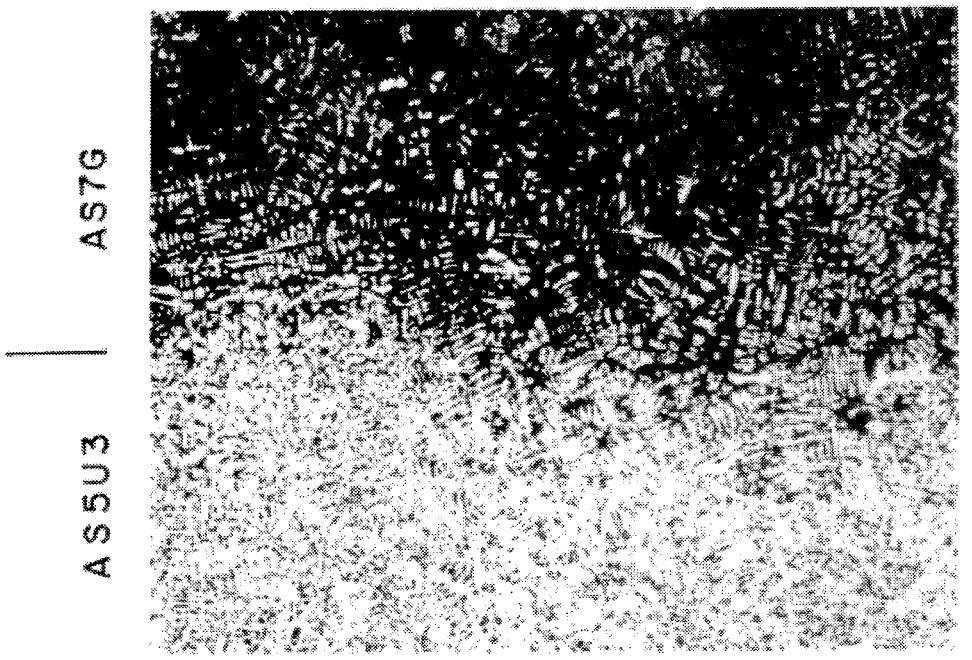
FIG. 5 shows a macrographic cross-section of the bonding region between the two alloys of the cylinder head obtained under the conditions reported in Example 1 at a magnification of 25×.
Figure 6:
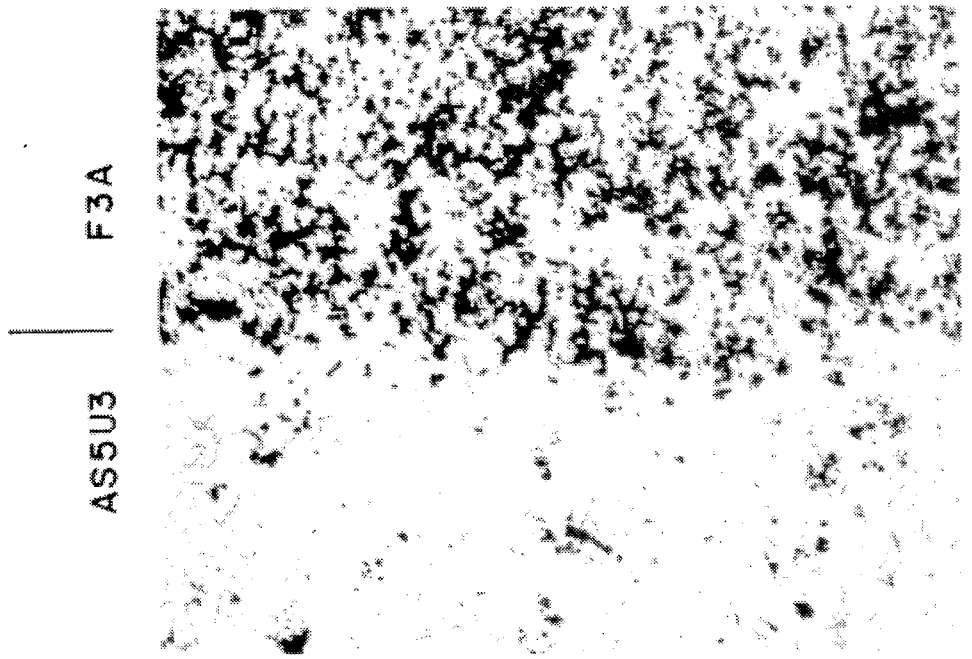
FIG. 6 shows a macrographic cross-section of the bonding region between the 2 alloys of the cylinder head obtained in accordance with the conditions of Example 2 at a magnification of 50×.

The following are defined from the equilibrium diagram of FIG. 8 for an alloy of Al—Si type of overall composition Co:

T the temperature of the alloy

T1 temperature of onset of solidification

T2 temperature of end of solidification (here coinciding with the eutectic plateau temperature)

C1 concentration of addition element in the metal solidified first

C2 concentration of addition element in the metal solidified last, before transformation of the eutectic liquid.

CM, average composition, solidified before the eutectic transformation is assumed to be similar to:

$$CM=(C1+C2)/2$$

C3 eutectic concentration

The usual rule of levers is then applied to determine the solidified fraction at each stage of the solidification preceding the isothermal (or eutectic) transformation.

Let fso be the solidified fraction obtained Just before the solidification of the eutectic (T=T2):

$$fso=(C3-Co)/(C3-CM)$$

The fraction, fs, solidified between T1 and T2 can be calculated either by this same rule of levers at each temperature or by the following formula, which is quicker, if the solidus and the liquidus of the alloy is assumed to be similar to two straight lines between T1 and T2 (a hypothesis which is wholly acceptable within the scope of the use of this patent application):

$$fs = \frac{(C3 - Co)(T1 - T)}{(C3 - CM)(T1 - T) + (Co - C1)(T - T2)} \quad (T2 \leqq T \leqq T1)$$

The fraction solidified during an isothermal, in particular eutectic, transformation plateau can be estimated from thermal analysis by virtue of a thermocouple placed in the layer being considered, assuming that the solidified fraction varies linearly with time during the isothermal transformation.

In the case of a transformation of binary type (FIG. No. 7) it can therefore be written, with a very good approximation, that the total solidified fraction Fs is equal to:

$$Fs = fso + (1 - fso)(t - to)/(t1 - to) \quad (to \leqq t \leqq t1)$$

since the alloy is completely solid at time t1.

What is claimed is:

1. Process for casting a composite cylinder head comprising a plurality of successive layers and at least two different alloys, comprising the steps of:

a) providing a mold having a cavity and a bottom portion with a metal sole plate cooled by circulation of heat exchange fluid;

b) casting a first alloy layer into the mold cavity, said first alloy layer including a lower portion and an upper portion; and c) casting at least one further alloy layer of different alloy composition into the mold cavity on said first layer, said at least one further layer having a lower portion adjacent the upper portion of a previously cast layer, and an upper portion;

d) providing by means of the cooled metal sole plate a thermal gradient in each said cast layer between the lower portion and the upper portion, the lower portion being at a lower temperature than the upper portion;

wherein the casting of a layer designated $i_n$ is begun at a time following the casting of previously cast layer $i_{n-1}$ of different alloy composition when the lower face of layer $i_{n-1}$ contains a solid fraction of between 70 and 100%, and the upper face layer $i_{n-1}$ contains a solid fraction of between 10 and 40%.

2. Process according to claim 1 wherein the mold is protected by an inert atmosphere during the casting.

3. Process according to claim 2 wherein the inert atmosphere is selected from the group consisting of $CO_2$, Ar and $N_2$.

4. Process according to claim 1 wherein the alloys are Al-based alloys.

5. Process according to claims 1 wherein the cast alloys contain fibres or ceramic particles.

6. Process according to claim 5 wherein the cast alloys contain SiC or $Al_2O_3$ fibers or particles.

7. Process according to claims 1 wherein the mold outside the sole plate is made of sand or metallic or mixed.

8. Process according to claim 1 wherein the alloy is an Al alloy, and the casting is done by low pressure, gravity plus low pressure, or gravity casting.

* * * * *